US010695809B2

(12) United States Patent
Kümmerling et al.

(10) Patent No.: US 10,695,809 B2
(45) Date of Patent: Jun. 30, 2020

(54) METHOD FOR PRODUCING HOT-ROLLED SEAMLESS PIPES HAVING THICKENED ENDS

(71) Applicant: Vallourec Deutschland GmbH, Düsseldorf (DE)

(72) Inventors: Rolf Kümmerling, Duisburg (DE); Henrike Bröker, Düsseldorf (DE); Thorsten Anke, Riesa (DE)

(73) Assignee: Vallourec Deutschland GmbH, Düsseldorf (DE)

( * ) Notice: Subject to any disclaimer, the term of this patent is extended or adjusted under 35 U.S.C. 154(b) by 500 days.

(21) Appl. No.: 15/500,766

(22) PCT Filed: Jul. 28, 2015

(86) PCT No.: PCT/EP2015/067236
§ 371 (c)(1),
(2) Date: Jan. 31, 2017

(87) PCT Pub. No.: WO2016/016224
PCT Pub. Date: Feb. 4, 2016

(65) Prior Publication Data

US 2017/0216896 A1 Aug. 3, 2017

(30) Foreign Application Priority Data

Aug. 1, 2014 (DE) ..... 10 2014 110 980

(51) Int. Cl.
*B21B 17/04* (2006.01)
*B21B 37/78* (2006.01)
(Continued)

(52) U.S. Cl.
CPC ..... *B21B 17/04* (2013.01); *B21B 27/024* (2013.01); *B21B 37/78* (2013.01); *B21B 23/00* (2013.01);
(Continued)

(58) Field of Classification Search
CPC ..... B21B 17/04; B21B 37/78; B21B 27/024; B21B 2271/02; B21B 2267/20;
(Continued)

(56) References Cited

U.S. PATENT DOCUMENTS

2004/0065133 A1* 4/2004 Sasaki ..... B21B 17/04 72/370.14
2006/0053855 A1* 3/2006 Yamane ..... B21B 37/78 72/208
(Continued)

FOREIGN PATENT DOCUMENTS

DE 3129903 A1 2/1983
DE 102004059091 A1 * 6/2006 ..... B21B 21/00
(Continued)

OTHER PUBLICATIONS

English translate DE102004059091A1, retrieved date May 21, 2019.*
(Continued)

*Primary Examiner* — Adam J Eiseman
*Assistant Examiner* — Mohammed S. Alawadi
(74) *Attorney, Agent, or Firm* — Gardner, Linn, Burkhart & Ondersma LLP

(57) ABSTRACT

A method for producing hot-rolled, seamless pipes having at least one wall thickening which can be arranged at any positions over the length of the pipe, wherein by means of a multiple-stand mandrel bar rolling mill, the rolls roll a hollow shell on a mandrel bar as an inner tool to a required nominal wall thickness and produce at specified positions over the length of the pipe a required wall thickening on the outer side of the pipe by opening the rolls in the rolling stands. The thickened wall is produced and finish-rolled by two rolling stands that are consecutive as seen in the rolling direction, in which the deviations of the finished contour of
(Continued)

the thickening from an ideal circular cross-section are minimised, wherein the rolling stands located upstream are likewise opened as to avoid any contact of the rolls of these rolling stands with the previously produced thickening.

17 Claims, 8 Drawing Sheets

(51) Int. Cl.
*B21B 27/02* (2006.01)
*B21B 23/00* (2006.01)

(52) U.S. Cl.
CPC ..... *B21B 2261/04* (2013.01); *B21B 2261/10* (2013.01); *B21B 2267/20* (2013.01); *B21B 2271/02* (2013.01)

(58) Field of Classification Search
CPC . B21B 2261/10; B21B 23/00; B21B 2261/04; B21B 17/00; B21B 17/02; B21B 2038/004; B21B 17/208; B21C 37/16
USPC ..... 72/248, 96, 208, 370.14, 370.15
See application file for complete search history.

(56) References Cited

U.S. PATENT DOCUMENTS

| | | | | |
|---|---|---|---|---|
| 2010/0326557 | A1 | 12/2010 | Ring et al. | |
| 2015/0121982 | A1* | 5/2015 | Yamane ..... | B21B 17/02 72/208 |
| 2016/0325325 | A1 | 11/2016 | Schafer et al. | |
| 2016/0362759 | A1 | 12/2016 | Schmidt et al. | |
| 2016/0376677 | A1 | 12/2016 | Delhaes et al. | |

FOREIGN PATENT DOCUMENTS

| | | | |
|---|---|---|---|
| DE | 102004059091 | A1 | 6/2006 |
| DE | 112013004557 | T5 | 6/2015 |
| EP | 0756682 | B1 | 5/2001 |
| EP | 1779939 | A1 | 5/2007 |
| EP | 2170540 | B1 | 8/2012 |
| JP | S60154810 | A | 8/1985 |
| JP | H9038711 | A | 2/1997 |
| JP | H105817 | A | 1/1998 |
| WO | 2012005287 | A1 | 1/2012 |
| WO | 2014045140 | A2 | 3/2014 |

OTHER PUBLICATIONS

International Search Report of the International Searching Authority from corresponding Patent Cooperation Treaty (PCT) Application No. PCT/EP2015/067236, indicated completed on Oct. 15, 2015.
Written Opinion of the International Searching Authority from corresponding Patent Cooperation Treaty (PCT) Application No. PCT/EP2015/067236, indicated completed on Feb. 4, 2016.
3reliminary Report on Patentability of the International Searching Authority in English from corresponding Patent Cooperation Treaty (PCT) Application No. PCT/EP2015/067236, completed Feb. 7, 2017.

* cited by examiner

METHOD FOR PRODUCING HOT-ROLLED SEAMLESS PIPES HAVING THICKENED ENDS

CROSS REFERENCE TO RELATED APPLICATION

The present application claims the priority benefits of International Patent Application No. PCT/EP2015/067236, filed Jul. 28, 2015, and claims benefit of DE 102014110980.5, filed on Aug. 1, 2014, which are hereby incorporated herein by reference in their entireties.

BACKGROUND AND FIELD OF THE INVENTION

The invention relates to a method for producing hot-rolled, seamless pipes with thickened ends.

Since the Mannesmann brothers' invention for producing a thick-walled, seamless hollow shell from a heated block, there have been various proposals for stretch-forming this hollow shell, in the same heat in a further hot working step, to a pipe. Keywords in this regard include e.g. the generally known continuous rolling method, push bench method, plug rolling method and pilgering method.

All of the aforementioned methods have their advantages for different dimensional ranges and materials, wherein there are also overlaps. The continuous rolling and plug rolling methods are used for the average dimensional range of 5" to 18" and the pilgering method is used for the dimensional range up to 26".

A characteristic feature of the production of seamless pipes from a heated block by means of hot-rolling are the three steps of piercing—elongation—final rolling with possible subsequent sizing of the diameter of the pipe ends during further processing.

In the case of line pipes which are joined by means of a welded connection to form a continuous run, it is important to be able to weld the pipes together as quickly as possible and without any internal offset of the pipes. One method of achieving this is by mechanical internal machining of the line pipe to an inner diameter of tight tolerance. In this case, in order to ensure that wall thickness does not fall short of the prescribed minimum wall thickness, it is expedient for these pipes to be thickened at the ends prior to mechanical machining on the inner side.

Another example is offered by oil field pipes, in which the individual pipes are joined by means of a thread-connection to form a continuous run. The pipes are provided with an integral thread and are thus screwed together without an additional pipe coupling. The threads introduced into the pipe weaken the pipe, which means that thread-connection points are able to absorb less of a load than the pipe body. Ends which are thickened on the outer and inner circumference render it possible to completely or partially compensate for this deficiency.

It is known that such pipes are thus frequently thickened at their ends in a separate process by means of hot-upsetting.

Such a method is known e.g. from the applicant's patent specification EP 2 170 540 B1 for producing hot-manufactured, seamless pipes, by means of which pipes are produced with optimised fatigue characteristics in the welded state and are welded in an automated manner on a pipe-laying vessel or on land to form pipelines.

In the case of this known method, in a first step a larger wall thickness is produced in one region of the relevant pipe end than in the rest of the pipe body. The wall thickening of the relevant pipe end region is produced by hot-upsetting of the pipe end, wherein the transitions to the pipe body which are produced during upsetting on the outer and inner circumference are arranged in an offset manner in relation to the pipe longitudinal axis.

In a second step, the required pipe cross-section is produced in this region by means of mechanical machining and the transition from the machined region to the un-machined region of the pipe is provided uninterruptedly with such a large radius or with radius combinations that a flowing and notch-free transition is achieved and the finished contour in the originally thickened end region of the pipe has an outer diameter which corresponds to the original diameter of the pipe.

Similar methods, in which thickenings of the pipe ends are produced towards the inside and outside by hot-upsetting and mechanical machining are known e.g. also from laid-open document DE 10 2004 059 091 A1 and patent specification EP 0 756 682 B1.

Further possible ways of producing thickenings by means of rolling technology are known for hot-pilgering. On the one hand, by opening the rolls the roll gap can be enlarged and a thicker wall can be pilgered. Pilger-rolls are sized in such a way that the circular arc cut into the smoothing part has its centre point on the rolling axis and the radius of the circular arc corresponds to the hot diameter of the pipe to be pilgered. The circular arc covers about an extent of 120° per roll. However, when the rolls are being opened a vertical oval is produced (see the explanation hereinafter relating to FIG. 1) which causes the material being rolled to become clamped and produces a more thinly pilgered wall in the flank region compared with the wall in the roll base. For this reason, only thickenings of a few millimetres can be achieved with this method.

Furthermore, from an economic perspective hot-pilgering is not a method which is suitable for the main dimensional range of oil field pipes and line pipes owing to the low quantities of approximately 10 pipes/operating hour of the rolling mill.

For the purpose of producing wall thickenings by means of cold-pilgering, it is proposed in laid-open document DE 31 29 903 A1 to provide the two pilger-rolls with two or even three grooves which are each provided for pilgering the different diameters. Cold-pilgering is an additional processing step which generates considerably more cost than e.g. separate hot-upsetting of the pipe ends and therefore is also not a suitable alternative for producing thickened pipe ends. Moreover, the pipe is only thickened towards the outside and is thus likewise unsuitable for joining line pipes by welding.

For economic reasons, oil field pipes and line pipes are thus mainly rolled at high performance installations, i.e. mandrel bar mills. The objective of mandrel bar mills is to stretch a hot hollow shell, which has been previously produced by skew-rolling, on a rolling mandrel to produce a main pipe. This main pipe is then reduced to the desired final dimension in a sizing or stretch-reducing mill.

Modern mandrel bar rolling mills have in the elongation unit, the actual mandrel bar rolling mill, hydraulic units which use servo-valves to control the settings of the rolls, in order thus to be able to perform positional changes very rapidly. This is currently already being used in order to produce e.g. pipe ends having a slightly reduced wall thickness which are then upset by the process-induced, reduced longitudinal pull during filling and emptying of the rolling stands of the reducing or stretch-reducing mill located downstream, and in this way are then provided at least in part for the pipe material and thus minimise the scrap at the top and bottom.

However, to date it has not yet been possible to produce wall thickenings, in relation to the required nominal wall thickness of the pipe, in a controlled manner over a specific length at the pipe end by means of a mandrel bar mill, as the problems encountered when opening the rolls during pilgering are also present in mandrel bar mills. Moreover, it is desirable, using rolling technology, to produce wall thickenings at specified positions on the pipe e.g. over half the length of the pipe in the case of double lengths, to ensure that, even in the case of double lengths, thickenings are provided at the ends of both pipes.

Furthermore, European patent document EP 1 779 939 B1 already discloses a rolling control method of a multiple-stand mandrel bar rolling mill for pipes. In a conventional manner, the rod rolling mill has a finishing rolling stand. In order to counteract known effects which produce rolled pipes having end regions with a lower wall thickness in comparison with the central regions of the pipe, the rolling control method ensures that the rolls of the finishing stand and of the rolling stand, which as seen in the rolling direction is located upstream thereof and has the same roll-reducing direction as the finishing rolling stand, are opened by a predetermined amount.

Furthermore, German patent DE 11 2013 004 557 T5 discloses a further control method for a pipe mandrel bar rolling mill, in which the length of the rolling stock is measured and/or calculated and in the region of a predetermined spaced interval from the end of the rolling stock the adjustment of the rolling stands is adapted such that the thickness of the pipe along the rolling axis is as constant as possible and also as identical as possible to a desired thickness.

SUMMARY OF THE INVENTION

It is an object of the invention to provide a method for producing hot-rolled, seamless pipes by means of a mandrel bar rolling mill, by means of which wall thickenings can be produced at the pipe end or at a defined position on the pipe with optimised roundness and without the addition of a separate upsetting process.

In a further object, the method is to be flexible such that the wall thickenings of the pipe can be produced on the inner side and on the outer side of the pipe in a variable manner by means of the forming units required for production of the finished pipe.

According to the teaching of the invention, there is provided a method for producing hot-rolled, seamless pipes having wall thickenings which can be arranged at any positions over the length of the pipe, in which by means of a multiple-stand mandrel bar rolling mill having at least three rolling stands and at least two rolls per stand, the rolls roll a hollow shell on a mandrel bar as an inner tool to a required nominal wall thickness and produce at specified positions over the length of the pipe a required wall thickening on the outer side of the pipe in comparison with the nominal wall thickness by opening the rolls in the rolling stands, which method is characterised by the fact that the thickened wall is produced and finish-rolled only by means of the two rolling stands at the specified positions, in which the deviations of the finished contour of the thickening from an ideal circular cross-section, which are produced by the roll contours when the rolls are being opened, are minimised, wherein the rolling stands located upstream thereof as seen in the rolling direction are likewise opened for a required wall thickness stepping of the rolling stands and all of the subsequent rolling stands are opened at least to such an extent as to reliably avoid any contact of the rolls of these rolling stands with the previously produced thickening and thus any subsequent reduction of the produced wall thickening.

In order to produce the wall thickening, the arrangement of the rolls which is offset over the circumference means that two rolling stands which are located one behind the other are always required, as it is only in this way that the complete circumference of the pipe comes into contact with the parts of the roll pass design intended to form the outer end geometry of the pipe.

Advantageously, in order to produce wall thickenings, on the one hand a high-performance mandrel bar rolling unit is used in accordance with the continuous rolling method for oil field pipes and line pipes, but on the other hand a subsequent hot-upsetting procedure to produce the wall thickening on the end of the pipe can be omitted. Moreover, this method renders it possible also to produce wall thickenings at any positions over the length of the pipe by opening the rolls in a controlled manner in the stands, so that wall thickenings can also be produced in the centre of the pipe and at the ends of the pipe e.g. during rolling of double lengths, i.e. twice the length of the required finished pipe length. After splitting the pipe in the region of the central wall thickening, the ends of both pipes then have the required wall thickenings. In the same manner, the wall thickenings can be produced on the pipe ends even when pipes having multiple lengths are being rolled.

In a first embodiment of the invention, the two stands which are intended to roll the wall thickening can be determined by means of simple test rolling procedures, in which initially a pipe which does not have thickenings is rolled with the selected mandrel bar. Then, during subsequent test rolling procedures pipes which have wall thickenings are rolled with the same mandrel bar and the deviations of the finished contour of the produced wall thickening from the ideal circular cross-section are determined for the rolling parameters selected for this purpose (selected rolling stands for rolling the thickening, roll setting and rotational speed, time sequences for all of the stands). The two rolling stands which produce the smallest geometric deviations taking into account the subsequent use and the still pending forming during final production are then subsequently selected for rolling the thickenings.

In a preferred embodiment of the invention, the test rolling procedures are replaced by an arithmetic determination and evaluation of the producible cross-sectional geometries on the thickenings for each stand, so that the stands which roll the most optimally circular cross-section possible can be predetermined in a simple and cost-effective manner and as a result costs for the test rolling procedures can be reduced.

For this purpose, an evaluation parameter BWV,i which is described in more detail in the following examples is introduced for arithmetically determining the two stands for rolling the rolling thickenings, wherein the rolling stand having the—in numerical terms—smallest geometric deviation from an ideal circular cross-section which is determined with the aid of an evaluation parameter BWV,i determined for each stand i is selected as the stand for finish-rolling of the wall thickenings and the rolling stand arranged upstream thereof as seen in the rolling direction is selected as the second stand. In a further advantageous embodiment of the invention, in order to roll the nominal pipe wall thickness at the exit of the mandrel bar rolling mill, the mandrel bar diameter is selected such that the deviations from an ideal circular cross-section, which are produced by the roll contours, with the nominal pipe wall thickness of the two last rolling stands in combination with the evaluation parameter BWV,i for rolling the thickenings are minimised and the mandrel bar diameter DSTist is established by a determined evaluation parameter BWR for rolling the nominal pipe wall thickness. In this case, the following applies: the smaller the evaluation parameter BWR, the smaller the geometric deviations of the nominal pipe wall thickness from the ideal circular ring. A BWR value of zero represents the ideal scenario.

The core idea behind the proposed, hitherto untypical method for producing wall thickenings in mandrel bar rolling mills resides in the fact that for each stand of the rolling mill the different geometric contours—which result from the roll geometry and the inner tool—of the produced pipe cross-section in the base of the groove and of the groove flanks are evaluated in a controlled manner. By means of the specific use of only the two stands for finish-rolling of the required wall thickening which produce the smallest geometric deviations from a circle, it is now possible to roll wall thickenings which previously could not be produced in this way on mandrel bar rolling mills.

As a result, it is possible to produce wall thickenings, which previously could not be produced, on the pipe end or at specified positions on the pipe and in this way the known problems which occur when the rolls are being opened are minimised and a maximum dimension of roundness can be achieved at the thickened locations on the pipe.

Depending upon the requirements of roundness of the pipe in the region of the nominal wall thickness and/or the thickening, this can advantageously be optimised accordingly with the aid of the inventive evaluation parameters BWV,i and BWR during rolling.

The basic problem which arises when the stands are being opened or closed during rolling of pipes by means of a mandrel bar rolling mill is illustrated once again hereinafter.

In contrast to rolling thinned ends, in which the roll gap is reduced the problem which occurs, as already described above, when the roll gap is being opened is that the further the distance travelled in the cut roll profile from the centre, the roll groove, towards the flank, the radial distance from the roll to the rolling axis increases less than the opening dimension, so that a vertical oval is produced. As already described previously, this problem occurs not only during pilger rolling but also during continuous rolling with mandrel bar rolling mills.

As a result of the sizing of the rolls, the direction of the opening dimension, which is perpendicular to the roll axis, and the radial direction, which is relevant for the wall thickness, coincide only in the roll groove.

DESCRIPTION OF THE PREFERRED EMBODIMENTS

Figure 1:
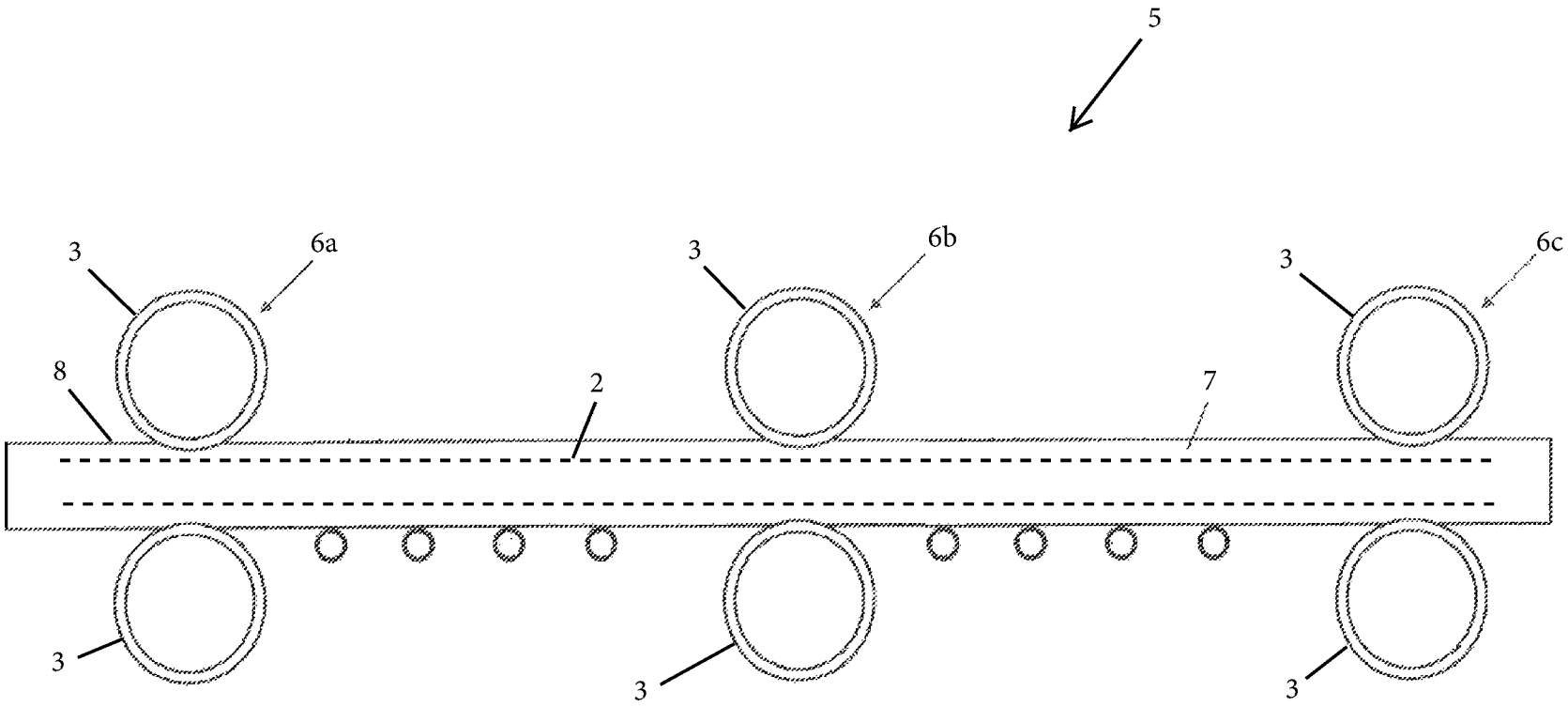
FIG. 1 illustrates a multiple-stand rolling mill.

FIG. 1 schematically shows a rolling mill 5 having multiple stands 6*a*, 6*b*, 6*c* that each include at least two rolls 3 used to produce pipe 7 from a shell 8 over mandrel bar 2.

Figure 1A:
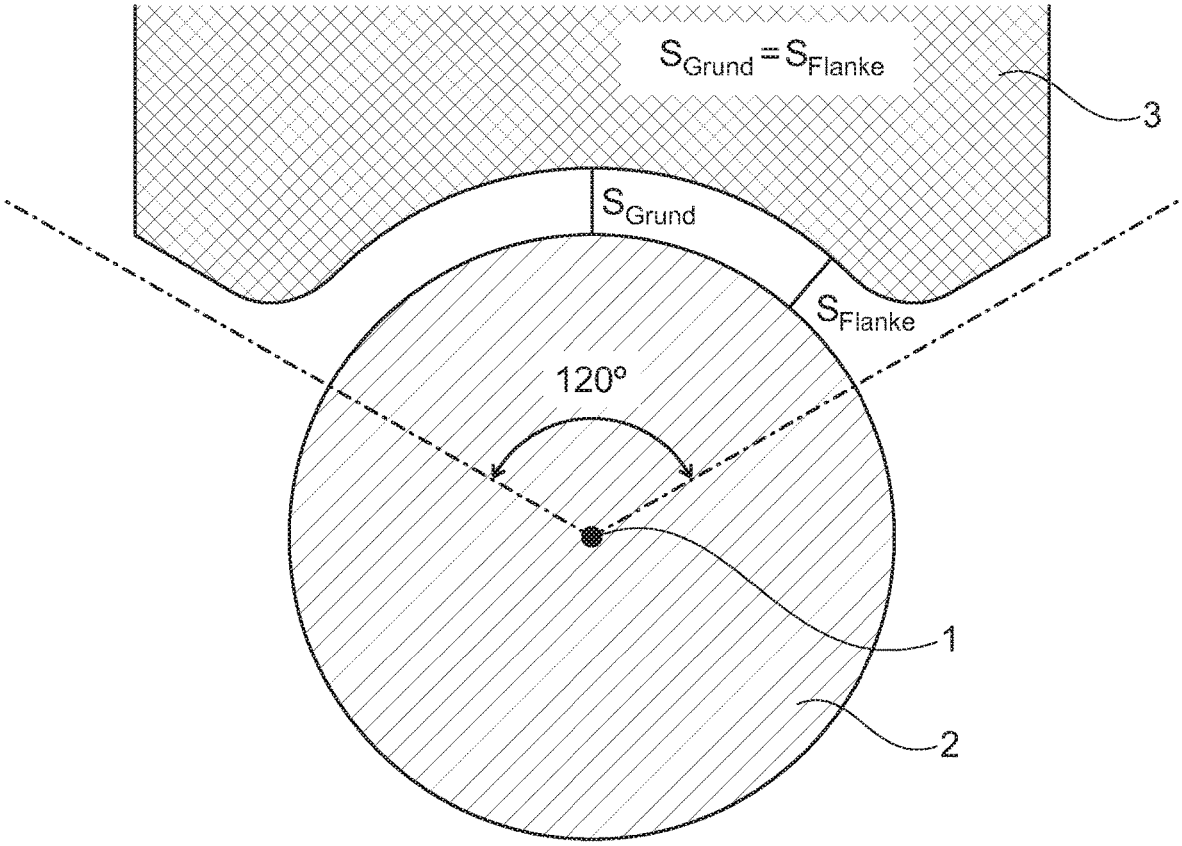
FIG. 1*a* illustrates a roll of a three-roll mandrel bar rolling mill in a zero position.
Figure 1B:
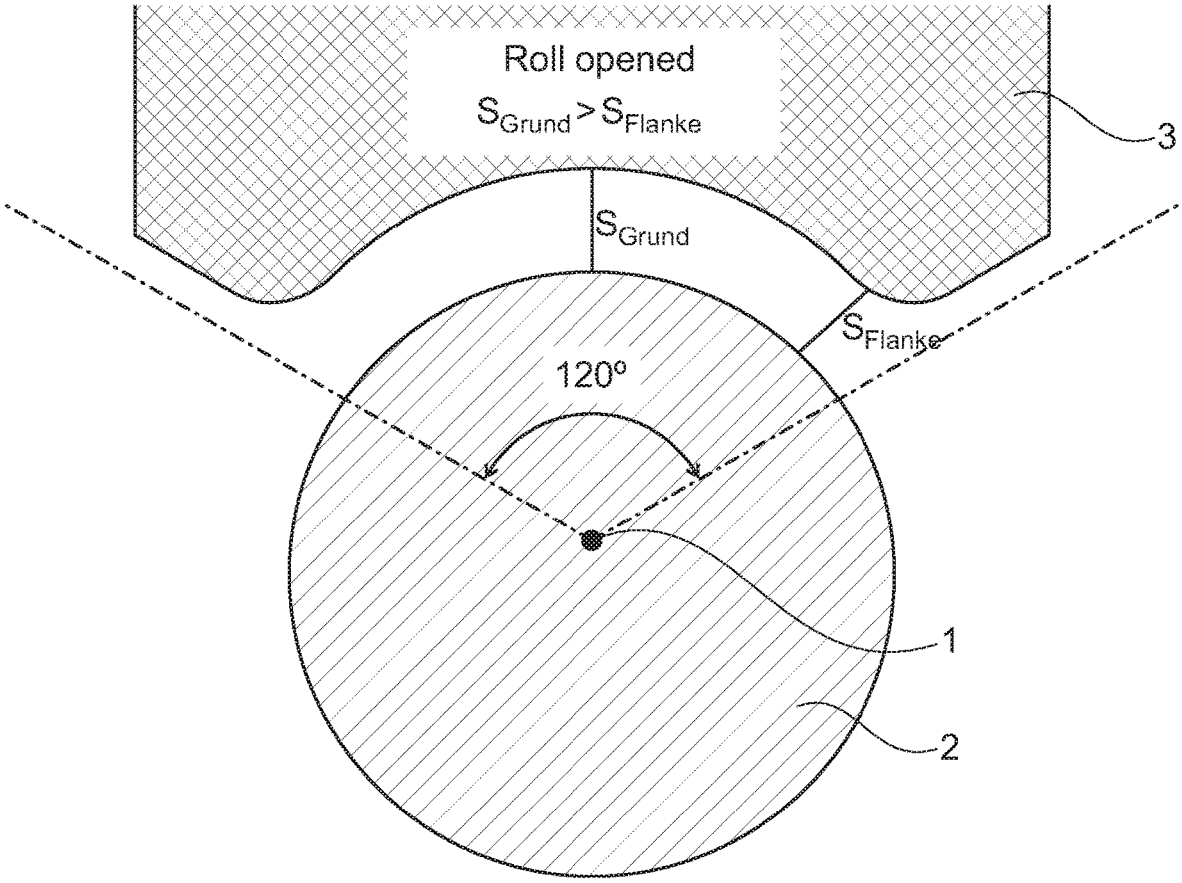
FIG. 1*b* illustrates a roll of a three-roll mandrel bar rolling mill in an open position.
Figure 1C:
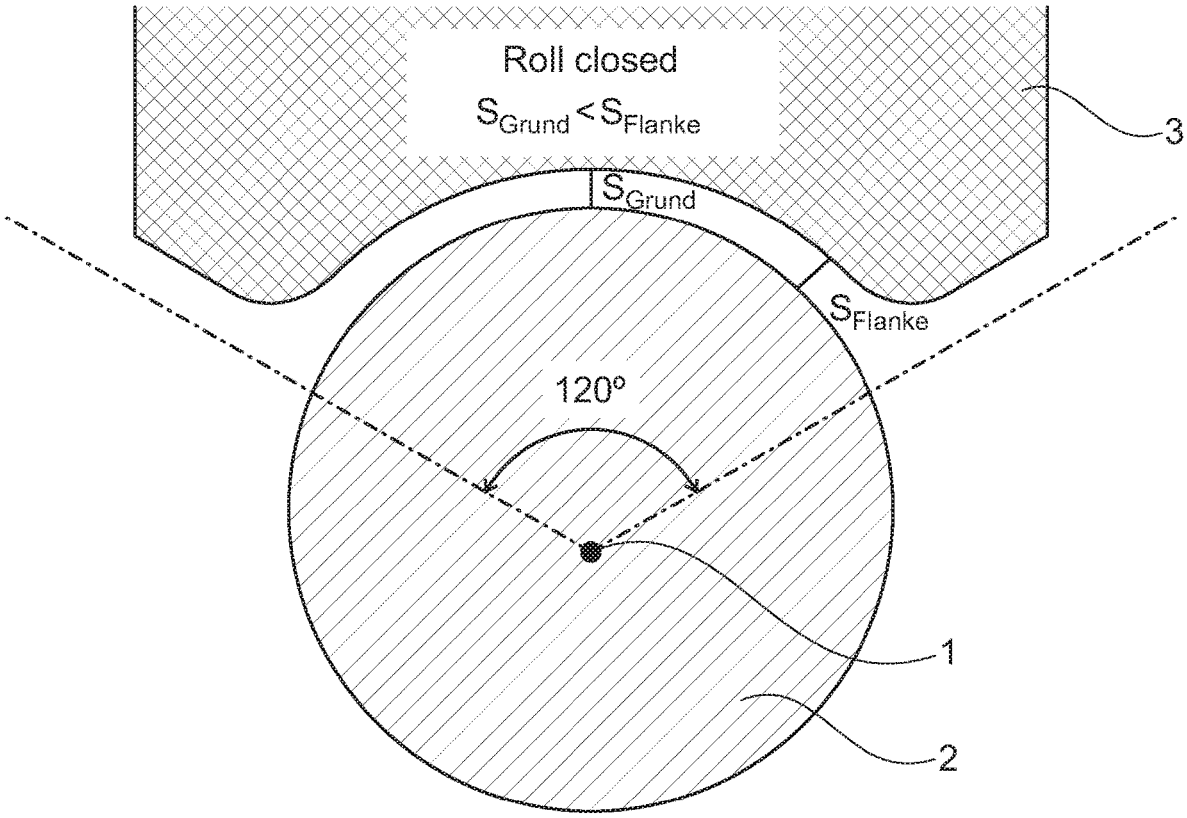
FIG. 1*c* illustrates a roll of a three-roll mandrel bar rolling mill in a closed position.

FIGS. 1*a*, 1*b* and 1*c* show, by way of example for a roll 3 of a three-roll mandrel bar rolling mill, the geometric locations for the zero position (see FIG. 1*a*) and for the opening and closing of the rolls 3 (see FIGS. 1*b* and 1*c*), wherein the roll contour of the roll 3 is illustrated in a simplified manner as a circular arc. FIG. 1*a* illustrates the mandrel bar 2 in cross-section, the rolling axis 1 and a part of the roll 3 in the zero position or in the neutral position. The rolling axis 1 and the axis of the mandrel bar are located one above the other. The roll gap is illustrated as a circular ring. The gap between the roll 3 and the mandrel bar 2 is the same size for the roll groove SGrund and the roll flank SFlanke.

When the rolls are being opened (see FIG. 1*b*), a larger gap is produced for the roll groove than for the roll flank, i.e. SGrund>SFlanke. The rolling axis 1 is displaced upwardly with respect to the axis of the mandrel bar.

If the roll 3 is closed (see FIG. 1*c*), the ratios are reversed and a smaller gap is produced for the roll groove than for the roll flank, i.e. SGrund<SFlanke. The rolling axis 1 is displaced downwards with respect to the axis of the mandrel bar.

A roll gap which is smaller in the flank compared to the roll groove is critical as the circumferential speed of the roll increases from the groove base to the flank. In combination with the roll gap which becomes smaller towards the flank, this can result in the material on the flank being pulled thin which in an extreme case can produce holes.

Figure 2:
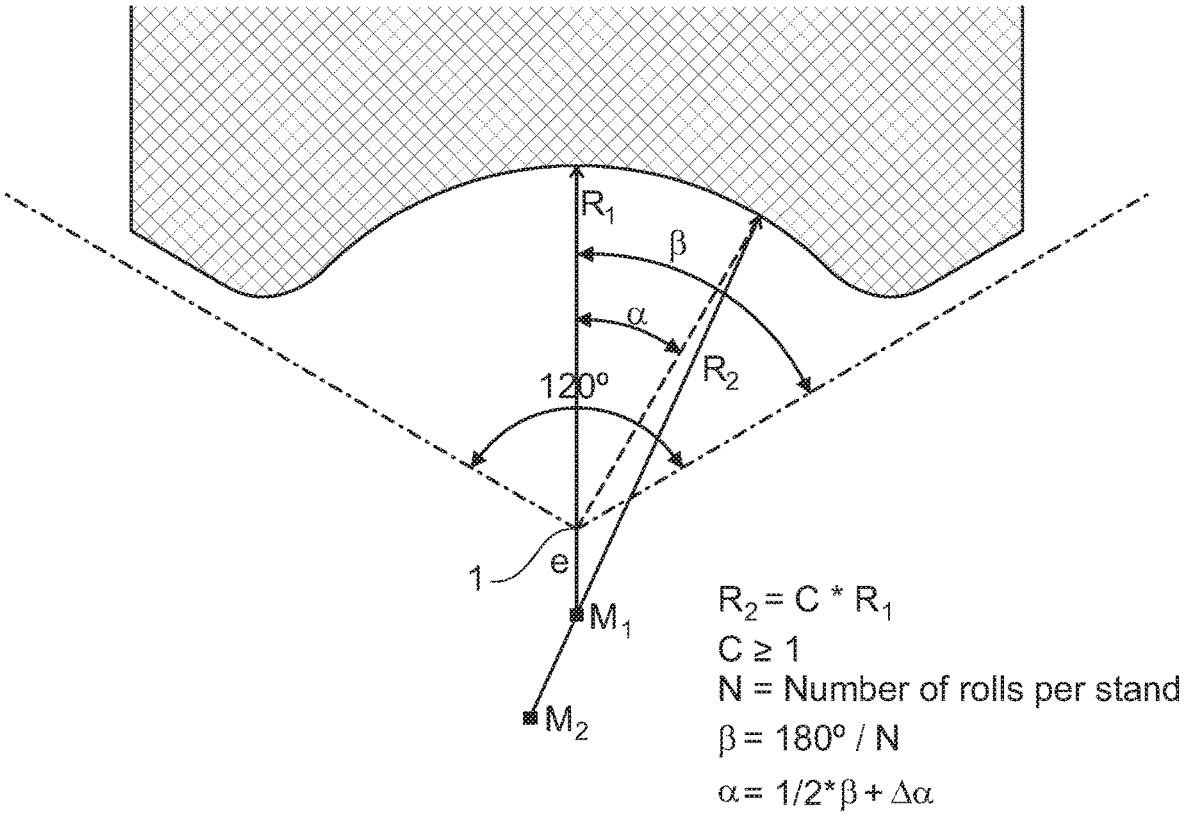
FIG. 2 shows the groove base radius R1 comprises a centre point M1 which is set with respect to the rolling axis 1 by central displacement e.

In order to ensure that these deviations remain under control, the roll pass design is composed typically of two circular arcs. FIG. 2 shows that the groove base radius R1 comprises a centre point M1 which is set with respect to the rolling axis 1 by central displacement e and the groove base radius R1 changes tangentially at angle alpha into the flank radius R2 having the centre point M2. The central displacement e corresponds to the perpendicular distance between the rolling axis 1 and the centre point M1. Since the rolls 3 in the successive stands are each arranged rotated with respect to one another by the angle beta, when the roll pass design of two stands arranged one behind the other is the same a contour is produced which is formed for an angle alpha=beta/2 only from the groove parts having the groove base radius R1. For example, an angle alpha of 30° is formed for a stand having three rolls.

Therefore, an exact circle is formed for a central displacement of e=0. However, in practice the angle alpha is selected to be slightly larger than half of the angle beta. However, this addition Delta alpha should not be greater than 5% of the angle beta.

The zero position of the rolls which is designated is the position at which the central displacement e corresponds to the desired value specified by the roll pass designer.

The minimum size of the factor C where R2=C×R1 for calculating the flank radius R2 from the base radius R1 is likewise deduced from geometric considerations. Even when the roll is being opened to the maximum intended extent, there should be no decrease in the wall thickness arriving at the flank, instead there should even be an air gap. Therefore, e.g. in the case of a three-roll mandrel bar rolling mill C-values greater than 2 are typical.

Figure 3:
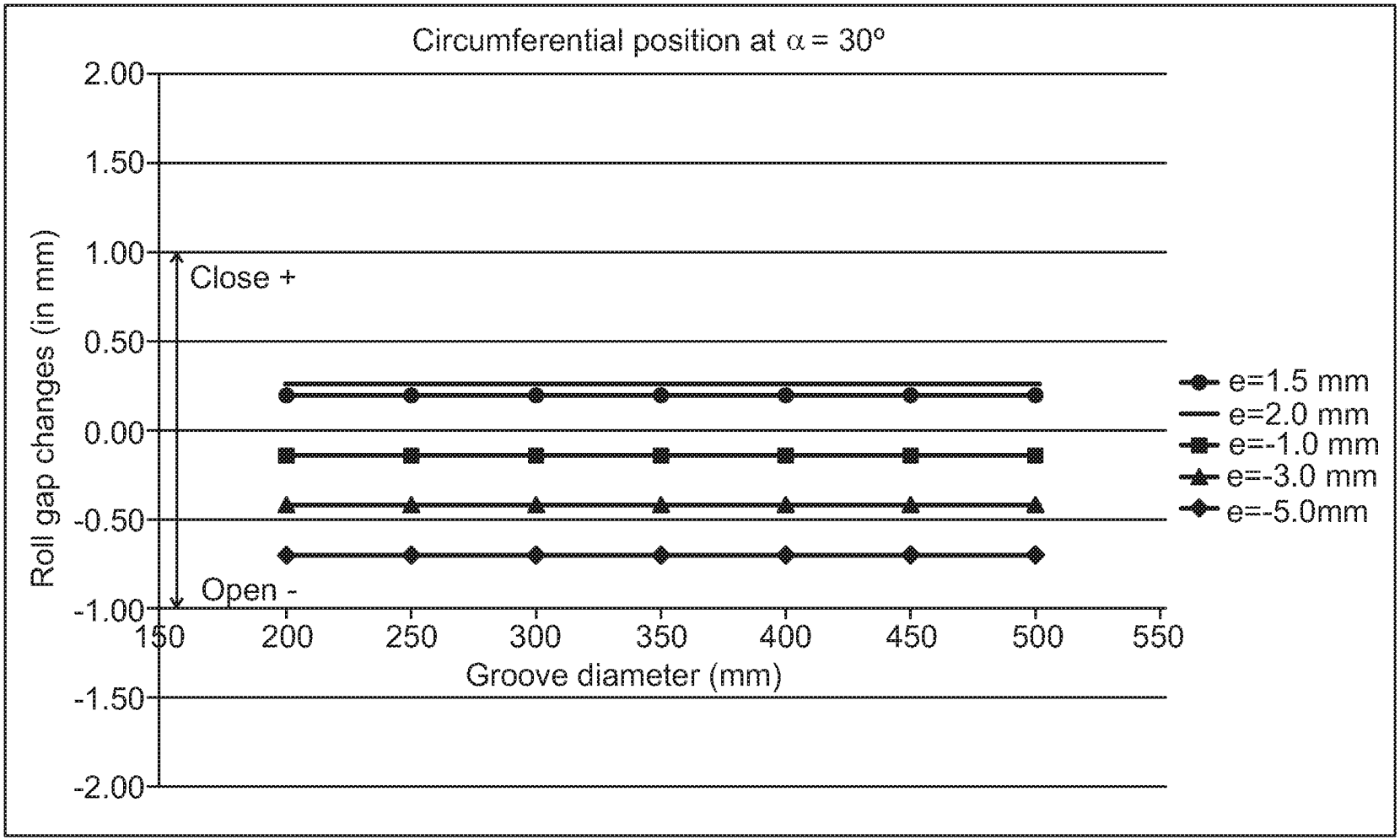
FIG. 3 shows for various groove diameters the roll gap change which occurs for various groove diameters and e-dimensions.

FIG. 3 shows for various groove diameters the roll gap change which occurs by way of example for a three-roll mandrel bar rolling mill in the case of alpha=30° circumferential position for various groove diameters and e-dimensions.

In order to overcome the described problems which occur when opening the rolls for the purpose of producing wall thickenings, the geometries of the wall thickenings which are produced with the individual stands and the deviation thereof from an ideal circular cross-section are evaluated in accordance with the invention. Starting from the wall thicknesses in the groove base, at the exit of all of the stands it is established at which stands does the wall thickening fall short of the required wall thickening during rolling of the pipe.

The two stands which produce the smallest geometric deviations from a circle are then used for rolling the wall thickenings. The settings of the rolls of the remaining stands and the rolls of the stand which is first to fall short of the required wall thickening are then opened in a controlled manner. In accordance with the invention, this opening procedure must satisfy the following two criteria.

Criterion 1: the two selected stands finish-roll the desired thickened wall thickness in the groove base. They are opened accordingly. All remaining stands located upstream are likewise opened so as to produce a suitable wall thickness stepping per stand for the purpose of rolling the thickening. In this connection, the term "suitable" means that the decreases in wall thickness in the stands which are required for rolling the thickened wall are relatively similar to when the nominal pipe wall thickness is being rolled. All subsequent stands are opened to such an extent as to reliably avoid any contact of the rolls with the pipe at the location of the thickening and thus any subsequent reduction in the wall thickening produced.

Criterion 2: The stands responsible for finish-rolling of the wall thickening are determined by the evaluation parameter BWV,i. The smaller the evaluation parameter BWV,i, the more the final contour of the thickened pipe part to be achieved corresponds to an exact circular ring.

The following examples explain the selection of the stands for finish-rolling of the desired wall thickening.

Example 1

A mandrel bar rolling mill comprising 5 stands and 3 rolls per stand is used for elongation and rolling the wall thickening.

The following applies:

i=sequential number of the stand, starting with 1 and ascending in the rolling direction i-max=sequential number of the last stand number of stands=5 s-R=pipe wall thickness at the exit of the mandrel bar rolling mill s-V=thickened wall The following also applies for each stand i:

s,i=wall thickness in the groove base of stand i e,i=eccentric displacement of the centre point of the groove base radius R1 to the zero position of the rolls in the stand i. The zero position of the rolls is the position which the roll pass designer has specified for establishing the groove contours, i.e. the specified groove contour and actual contour are identical when the rolls are in the zero position in the stand.

DSTideal=ideal mandrel bar diameter with which the pipe wall s-R is rolled when the roll position is in the zero position.

DSTist=mandrel bar diameter used for rolling of s-R

A-ges.=identical setting dimension for all roll positions, so that the pipe wall thickness s-R can be rolled with the actual mandrel bar diameter, +=rolls are opened with respect to the zero position.

−=rolls are closed with respect to the zero position.

The opening and closing dimensions are defined as radial distances.

$$A\text{-}ges. = \tfrac{1}{2} \times (DSTist - DSTideal)$$

eR,i=actual centre point displacement of the groove base radius R1,i in comparison with the rolling axis (+=above rolling centre, −=below rolling centre during rolling of the pipe wall s-R)

A,i—theoretical opening dimension of stand i, in order to roll the thickened wall in the groove base $$A,i = s\text{-}V - s,i$$

ev,i=centre point displacement of the groove base radius R1,i in comparison with the rolling axis (+=above rolling centre, −=below rolling centre during rolling of the thickened wall s-V)

$$ev,i = eR,i + A,i$$

BWR=evaluation parameter for rolling the nominal pipe wall thickness in the form of an absolute value $$BWR = |eR,i\text{-max} - 1 + eR,i\text{-max}| \text{ for } i\text{-max} = 5$$

BWV,i=evaluation parameter for rolling the thickened wall s-V in the form of an absolute value $$BWV,i = |ev,i - 1 + ev,i| \text{ for } i = 2 \text{ to } i\text{-max} \quad (5)$$

MIN BWV,i=smallest value from the evaluation parameters BWV,i determined for all from the second stand with the respective sequential numbers i.

TABLE 1

Basic configuration of a 5-stand mandrel bar rolling mill and Examples 1 and 2 for rolling of thickenings

| | Variant | | | | | | | | | | | |
|---|---|---|---|---|---|---|---|---|---|---|---|---|
| | Basis | | | | Example 1 | | | | | Example 2 | | |
| | s-R | | | | | | | | | | | |
| | 10 | | | | 10 | | | | | 10 | | |
| | s-V | | | | | | | | | | | |
| | | | | | 11 | | | | | 11 | | |
| | DSTist | | | | | | | | | | | |
| | DSTideal | | | | DSTideal | | | | | DSTideal-2 | | |
| | A-ges | | | | | | | | | | | |
| | 0 | | | | 0 | | | | | −1 | | |
| | Stand i | | | | | | | | | | | |
| | s, i | e, i | eR, i | A, i | BWR | ev, i | BWV, i | eR, i | A, i | BWR | ev, i | BWV, i |
| 1 | 18.5 | −3.0 | −3.0 | −7.5 | | −10.5 | | −4.0 | −7.5 | | −11.5 | |
| 2 | 14.0 | −1.0 | −1.0 | −3.0 | | −4.0 | 14.5 | −2.0 | −3.0 | | −5.0 | 16.5 |
| 3 | 11.0 | 0.0 | 0.0 | 0.0 | | 0.0 | 4.0 | −1.0 | 0.0 | | −1.0 | 6.0 |
| 4 | 10.0 | 0.0 | 0.0 | 1.0 | | 1.0 | 1.0 | −1.0 | 1.0 | | 0.0 | 1.0 |
| 5 | 10.0 | 0.0 | 0.0 | 1.0 | 0.0 | 1.0 | 2.0 | −1.0 | 1.0 | 2.0 | 0.0 | 0.0 |

All dimensions in mm

TABLE 2

Basic configuration of a 5-stand mandrel bar rolling mill and Examples 3 and 4 for rolling of thickenings

| | Variant | | | | | | | | | | | |
|---|---|---|---|---|---|---|---|---|---|---|---|---|
| | Basis | | | | Example 3 | | | | | Example 4 | | |
| | s-R | | | | | | | | | | | |
| | 10 | | | | 10 | | | | | 10 | | |
| | s-V | | | | | | | | | | | |
| | | | | | 13 | | | | | 18 | | |
| | DSTist | | | | | | | | | | | |
| | DSTideal | | | | DSTideal-2 | | | | | DSTideal-3 | | |
| | A-ges | | | | | | | | | | | |
| | 0 | | | | −1 | | | | | −1.5 | | |
| | Stand i | | | | | | | | | | | |
| | s, i | e, i | eR, i | A, i | BWR | ev, i | BWV, i | eR, i | A, i | BWR | ev, i | BWV, i |
| 1 | 18.5 | −3.0 | −4.0 | −5.5 | | −9.5 | | −4.5 | −0.5 | | −5.0 | |
| 2 | 14.0 | −1.0 | −2.0 | −1.0 | | −3.0 | 12.5 | −2.5 | 4.0 | | 1.5 | 3.5 |
| 3 | 11.0 | 0.0 | −1.0 | 2.0 | | 1.0 | 2.0 | −1.5 | 7.0 | | 5.5 | 7.0 |
| 4 | 10.0 | 0.0 | −1.0 | 3.0 | | 2.0 | 3.0 | −1.5 | 8.0 | | 6.5 | 12.0 |
| 5 | 10.0 | 0.0 | −1.0 | 3.0 | 2.0 | 2.0 | 4.0 | −1.5 | 8.0 | 3.0 | 6.5 | 13.0 |

All dimensions in mm

The starting position designated in Tables 1 and 2 as the basis shows the roll positions in the zero position, the mandrel bar used corresponds to the ideal mandrel bar for rolling a nominal pipe wall thickness of 10 mm at the exit of the mandrel bar rolling mill.

In Example 1 of Table 1, the thickened wall to be produced is 11 mm. Therefore, a wall thickening of 1 mm is to be produced. Since the mandrel bar used corresponds to the ideal mandrel bar, the roll setting in total (A-ges) is equal to zero and the centre point displacements eR,i are identical to the values for the zero position of the rolls. In order to roll a wall thickness of 11 mm, the rolls must be opened by 1 mm with respect to the nominal pipe wall thickness of 10 mm.

Stand 4 with a value of 1.0 has the numerically smallest value for the evaluation parameter MIN BWV,i, i.e. when the thickening is being rolled by stand 4, the smallest deviations from an ideal circular ring occur. Since stand 4 has the smallest value MIN BWV,i the thickening is finish-rolled with the stand 3 located upstream thereof in the rolling direction and the already determined stand 4, since the stand 4 produces, in terms of a finishing stand, a pipe with the smallest geometric deviations from an ideal circular ring.

Therefore, only the first 4 stands are required for producing the wall thickening, wherein the stands 3 and 4 finish-roll said wall thickness of 11 mm. Stand 5 is then only still required for rolling the nominal pipe wall thickness of 10 mm.

Example 2

In Example 2 of Table 1, in the case of a nominal pipe wall thickness of likewise 10 mm and a required wall thickening of 1 mm, rolling is performed with a mandrel bar which is 2 mm smaller in diameter, i.e. DSTideal minus 2 mm. In this case, a 0.0 is shown to be the most favourable evaluation MIN BWV,i for stand 5. Therefore, in this variant all 5 stands are required for rolling the thickening, wherein the last two stands, i.e. stands 4 and 5, finish-roll the thickening of 11 mm wall thickness.

Examples 3 and 4

Examples 3 and 4 of Table 2 show the situation for a thickened pipe wall of 13 or 18 mm with a nominal pipe wall thickness of likewise 10 mm. In this case, for a wall thickening to 13 mm (Example 3) only the first 3 stands are required, as the lowest BWV-value MIN BWV,i of 2.0 is achieved for stand 3. In Example 4 for a thickening of the pipe wall to 18 mm, stand 2 at 3.5 has the lowest BWV-value so that only the first two stands finish-roll the wall thickening.

Figure 4A:
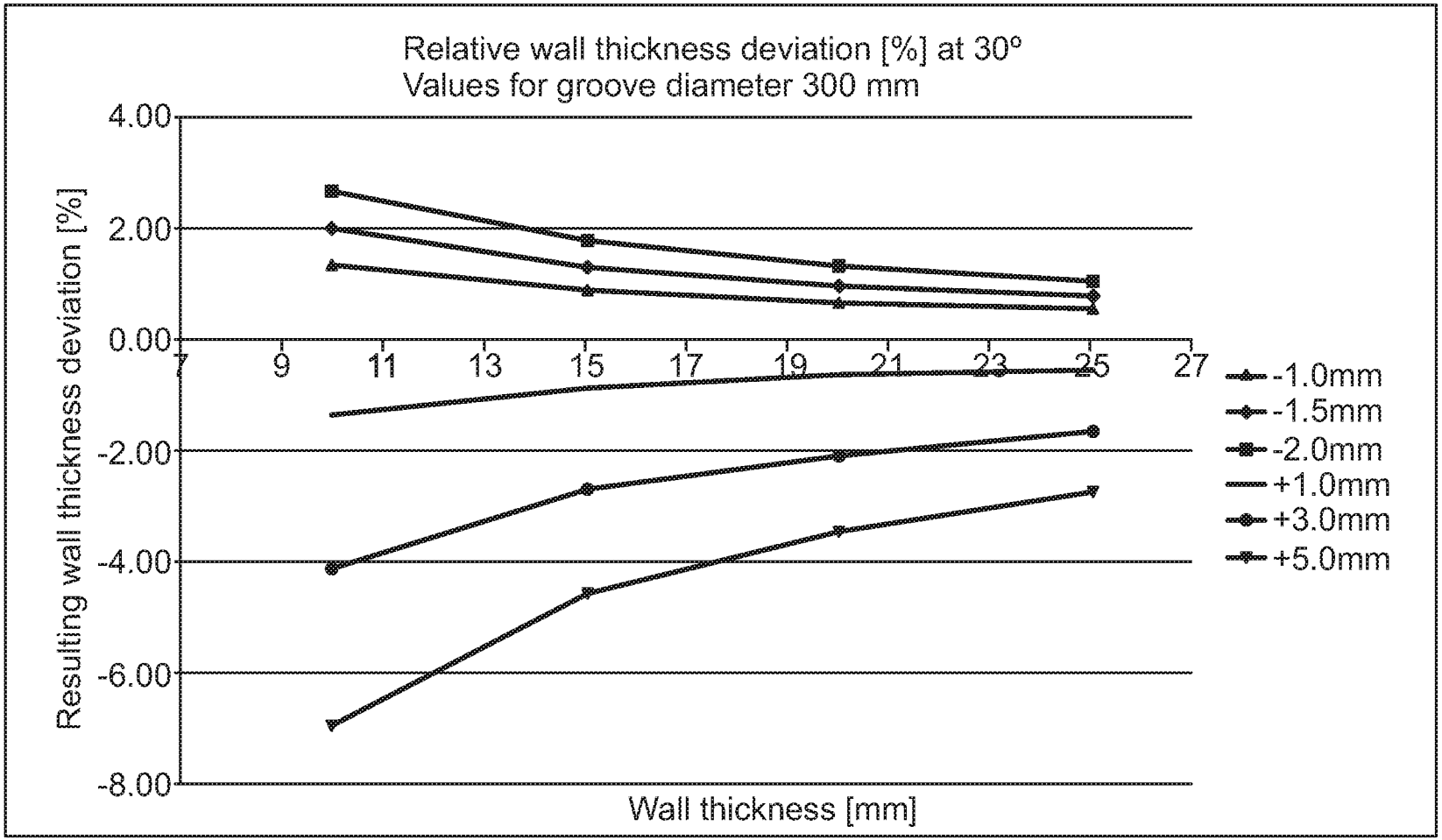
FIGS. 4*a* and 4*b* show which wall thickness deviations are produced relatively (FIG. 4*a*) and absolutely (FIG. 4*b*) for different centre point displacements of the groove base radii.
Figure 4B:
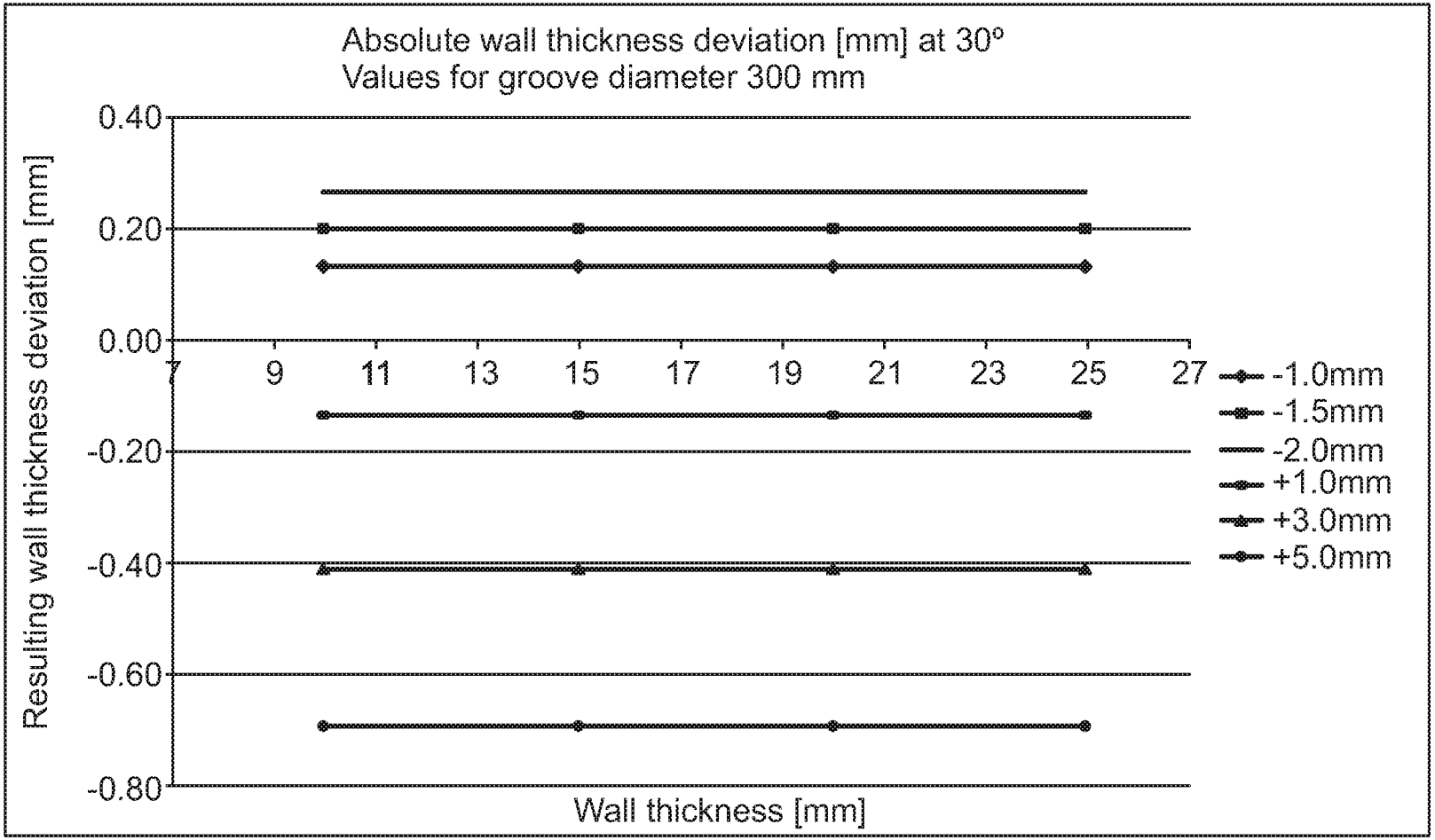

It is also apparent from Table 2 that positive ev,i values cannot be avoided in all cases. Therefore, in theory ranges are also produced in which the target thickening cannot be achieved. FIG. 4 shows, in the case of a three-roll mandrel bar rolling mill and thus in accordance with the quoted Examples, which wall thickness deviations are produced relatively (FIG. 4*a*) and absolutely (FIG. 4*b*) for different centre point displacements ev,i (in the range of −2.0 mm to +5.0 mm) of the groove base radii.

Since the contour of the rolls determines the outer contour of the pipe and the wall thickness is formed by the mandrel bar diameter, the absolute wall thickness deviations are always the same when the rolls are opened or closed. Therefore, when said rolls are opened by 1 mm, a wall thinning of about 0.13 mm is produced and when opened by 5 mm a wall is produced which is thinner by about 0.69 mm. When said rolls are closed by 1 mm, the maximum deviation is +0.14 mm. The relative values decrease more and more as the wall thickness increases. The illustration showing curves made up of straight line portions has only been selected for greater clarity.

Ultimately, the type of further processing and the method used for sizing the pipe ends determine the still tolerable wall thickness deviations.

In theory, the method described can be used to produce thickened walls which correspond at most to the hollow shell wall thickness. In the Examples in accordance with Table 1, the hollow shell wall thickness is 25 mm.

As described above, the mandrel bar diameter DSTist for achieving optimum roundness for rolling the nominal pipe wall thickness is established by means of a determined evaluation parameter BWR.

In Examples 1 and 2 of Table 1, with otherwise identical geometric specifications for the pipe to be rolled, the evaluation parameters BWR in Example 1 are calculated as 0.0 and in Example 2 as 2.0 by the formula BWR=|eR, imax-1+eR,imax| for i-max=5.

As described, the geometric deviations of the nominal pipe wall thickness from the ideal circular ring are smaller, the smaller the BWR value. In the present case, the mandrel bar diameter DSTideal in accordance with Example 1 would thus be selected.

However, the requirement of the wall thickness tolerances of the pipe, rolling technology aspects and the requirements of the wall thickness uniformity of the thickenings are to be weighed up against one another in order to establish the most suitable mandrel bar diameter and thus the BWR-value, and the BWV,i effective for the thickenings and thus the stands required for rolling the thickening.

Although a BWR-value of zero is theoretically the best, but due to the longitudinal tensile stresses in the flank region, negative eR,max and eR,imax-1 which lead to a BWR deviating from zero with simultaneous improvement of the BWV,i can represent the better solution. In practice, Example 2 with a mandrel bar diameter DSTist=DSTideal minus 2 mm with thin wall thicknesses where the longitudinal tension can be critical and thus delivers the better rolling results.

However, the mandrel bar must still be removed from the so-called continuous pipe, which is how the pipe is referred to after it has been rolled in the mandrel bar rolling mill. Typically, the pipe downstream of mandrel bar rolling mills having two rolls per stand is designated as the continuous pipe. However, in this case the term generally stands for a pipe which is rolled in mandrel bar rolling mills, irrespective of how many rolls are used per stand.

The mandrel bar can be removed from the continuous pipe by extracting it in the secondary flow via a chain after rolling. However, the common method is a so-called extracting mill which in the rolling line pulls the continuous pipe from the mandrel bar and advantageously can be used to displace the wall thickening located on the outer side of the pipe towards the inner side of the pipe.

For this purpose, three three-roll stands are generally used which at least reduce the diameter of the continuous pipe by about 2.5%. Removal of the pipe with the aid of the extracting mill commences as soon as the pipe head reaches the extracting mill. At this point in time, the rolling procedure in the mandrel bar rolling mill is not yet completed in most cases. The rolling procedure in the mandrel bar rolling mill ends at the latest when the mandrel bar head comes to a standstill just upstream of the extracting mill. Then, the extracting mill removes from the mandrel bar the remaining part of the pipe which is still located thereon.

The maximum values of the diameter reduction are about 4.5% in total across all three stands. If e.g. an 11 mm continuous pipe wall thickness is rolled and the thickening is intended to be 10 mm, this signifies an increase in the outer diameter reduction by 20 mm, which in the case of a 200 mm groove already constitutes 10%. Since the settings of the rolls of the extracting stands are generally not variable, it is necessary to adapt the roll pass design for larger wall thickenings. This has to be performed in such a manner that the minimum decrease for the filet part is effected only in at most two stands, preferably only in the last one. Therefore, the two front stands can each perform the additionally required diameter reduction which, however, should not exceed 4.5% per stand.

In a further variant, in order to extract the mandrel bar an extracting mill is not used and instead the mandrel bar is extracted by means of a sizing or stretch-reducing mill. In this case, extraction of the mandrel bar is simpler than in the case of the extracting mill, since depending on the thickening of the pipe ends, one or a plurality of additional stands merely have to be placed upstream of the stands required for reducing the filet parts. The pipe sections which have the nominal wall thickness are designated as the filet parts.

The diameter reduction in the extracting or stretch-reducing mill ensures that the thickenings are urged inwardly and the pipe externally has a constant outer diameter. This has the advantage that transportation of the pipes and also the heat treatment required in most cases can be performed without additional measures. However, it is likewise possible to distribute the wall thickening in any manner towards the outer side and inner side of the pipe.

When used in the production line for line or oil field pipes, the ends are then sized by means of a calibrating press or other suitable unit so as to produce a wall thickness progression of the pipe ends in accordance with the specifications. The forming required for this purpose and customer specification with regard to permitted deformations in the cold state and internal stresses can mean that the pipe ends must be preheated and/or also post-heated. Then, the further steps are conducted in order ultimately to produce the desired end product according to specification. The hydraulic pressure test which is prescribed in most cases is performed in each case depending on specification before or after sizing of the pipe ends.

Therefore, in order to produce thickened ends, the following procedure is adopted in accordance with the invention:

1. Specify the wall thickness progression at the pipe ends of the finished pipe and the tolerances to be observed prior to mechanical further processing, such as internal or external machining, threading or the like.
2. Specify the length range with the finished pipe wall, the filet part, and the tolerances to be observed.
3. Convert the wall thickness progression on the finished pipe into a wall thickness progression with a wall thickness increase towards the outside for the pipe in the run-out of the mandrel bar rolling mill, the continuous pipe, taking into account the stretching and change in wall thickness through the sizing or stretch-reducing mill and the extracting mill, if present, and the required crop cuts. The continuous pipe can optionally contain multiple lengths of the finished pipe.
4. Calculate the specifications for the roll setting of the individual stands to match the pre-calculated geometry progression of the continuous pipe in all of the stands, taking into account the introduced evaluation parameters BWV,i and BWR for determining the stands for finish-rolling of the desired thickening and the resulting geometry in the opened state as described above. Stands which are no longer required for rolling the thickening or the transition are opened to such an extent that in a reliable manner they no longer effect any wall deformation.
5. Calculate the cross-sections of the continuous pipe over the length with the associated surface areas at the exit of each stand.
6. Specify the desired exit speed of the continuous pipe downstream of the last stand. If the continuous pipe runs out at a constant speed, the roll rotational speeds of the extracting mill do not need to be regulated.
7. Calculate the roll settings over time for all stands in accordance with points 5 and 6.
8. Calculate the continuous pipe speeds over time at the run-out of each stand in accordance with point 7.
9. Calculate the roll rotational speeds over time for all stands.
10. Produce the adjustment specifications and data records required for controlling the mandrel bar rolling mill in order to control the roll settings and the roll rotational speeds.
11. Roll the hot-finished pipe in the sizing or stretch-reducing mill, in which all wall thickenings are now located on the inside as a result of the reduction in the outer diameter, and perform the required crop and partial cuts.
12. If required, temper the pipe and examine the mechanically-technological properties.
13. Perform non-destructive testing of the pipe according to specification.
14. Size the pipe ends, optionally with heating to avoid cold work hardening and internal stresses.
15. Perform the hydraulic pressure test and further steps to produce the end product according to specification.

The invention claimed is:

1. A method for producing hot-rolled, seamless pipes having at least one wall thickening which can be arranged at any positions over the length of the pipe, comprising:

rolling a hollow shell on a mandrel bar as an inner tool with rolls of a multiple-stand mandrel bar rolling mill having at least three rolling stands and at least two rolls per stand to a required nominal wall thickness;

producing at specified positions over the length of the pipe a required wall thickening on the outer side of the pipe in comparison with the nominal wall thickness by opening the rolls in the rolling stands, wherein the thickened wall is produced and finish-rolled only by two rolling stands of the at least three rolling stands, which are consecutive as seen in a rolling direction, at the specified positions, in which deviations of the finished contour of the thickening from an ideal circular cross-section, which are produced by the roll contours when the rolls are being opened, are minimised, wherein the rolling stands of the at least three rolling stands located upstream thereof as seen in the rolling direction are also opened for a required wall thickness stepping of the rolling stands and all of the subsequent rolling stands of the at least three rolling stands are opened at least to such an extent as to avoid any contact of the rolls of these rolling stands with the previously produced thickening and thus any subsequent reduction of the produced wall thickening; and establishing the two rolling stands which roll the wall thickening by a calculated evaluation parameter BWV, i, wherein the rolling stand having the smallest geometric deviation from an ideal circular cross-section in numerical terms and thus the smallest evaluation parameter BWV,i is selected as the first stand for finish-rolling of the wall thickening and the rolling stand arranged upstream thereof as seen in the rolling direction is selected as the second stand, wherein the evaluation parameter BWV,i is defined as follows:

$$BWV,i=|ev,i-1+ev,i| \text{ for } i=2 \text{ to } i\text{-max}$$

where i=sequential number of the stand, starting with 1 and ascending in the rolling direction i-max=sequential number of the last stand wherein ev,i=centre point displacement of the groove base radius R1,i in comparison with the rolling axis (+=above rolling centre, –=below rolling centre during rolling of the thickened wall s-V)

where $$ev,i=eR,i+A,i,$$

wherein eR,i=the centre point displacement of the groove base radius R1,i in comparison with the rolling axis (+=above rolling centre, –=below rolling centre) during rolling of the nominal pipe wall thickness s-R and A,i=theoretical opening dimension of stand i, in order to roll the thickened wall s-V in the groove base, where $$A,i=s\text{-}V-s,i,$$

wherein s,i=wall thickness in the groove base of stand i.

2. The method as claimed in claim 1, further comprising determining the two rolling stands which roll the wall thickening by test rolling procedures, wherein initially a pipe which does not have thickenings is rolled with a selected mandrel bar and in further test rolling procedures pipes which have wall thickenings are rolled with the selected mandrel bar and the deviations of the finished contour of the produced wall thickening from the ideal circular cross-section are measured for rolling parameters selected for this purpose and subsequently the two rolling stands which produce the smallest geometrical deviation in the finished contour from the ideal circular cross-section are selected.

3. The method as claimed in claim 2, further comprising extracting the mandrel bar from the pipe after rolling in the mandrel bar rolling mill and subsequently urging the wall thickenings on the outer side of the pipe to the inner side of the pipe by subsequent rolling so as to produce a pipe having a constant outer diameter over the entire length.

4. The method as claimed in claim 3, wherein the wall thickenings are urged completely to the inner side of the pipe by a mandrel bar extracting mill, which is located downstream of the mandrel bar rolling mill, or a stretch-reducing mill.

5. The method as claimed in claim 4, further comprising subsequently urging in part the wall thickenings from the inner side of the pipe to the outer side of the pipe by a calibrating press.

6. The method as claimed in claim 1, wherein in order to roll the nominal pipe wall thickness s-R at the exit of the mandrel bar rolling mill, the mandrel bar diameter DSTist is selected such that the deviations from an ideal circular cross-section, which are produced by the roll contours, with the nominal pipe wall thickness s-R of the last rolling stand are minimised and the mandrel bar diameter DSTist is established by a calculated evaluation parameter BWR for rolling the nominal pipe wall thickness which is defined as follows as a value:

$$BWR=|eR,i\text{-max}-1+eR,i\text{-max}| \text{ for } i\text{-max}$$

where i-max=sequential number of the last stand.

7. The method as claimed in claim 6, further comprising extracting the mandrel bar from the pipe after rolling in the mandrel bar rolling mill and subsequently urging the wall thickenings on the outer side of the pipe to the inner side of the pipe by subsequent rolling so as to produce a pipe having a constant outer diameter over the entire length.

8. The method as claimed in claim 7, wherein the wall thickenings are urged completely to the inner side of the pipe by a mandrel bar extracting mill, which is located downstream of the mandrel bar rolling mill, or a stretch-reducing mill.

9. The method as claimed in claim 8, further comprising subsequently urging in part the wall thickenings from the inner side of the pipe to the outer side of the pipe by a calibrating press.

10. The method as claimed in claim 1, further comprising extracting the mandrel bar from the pipe after rolling in the mandrel bar rolling mill and subsequently urging the wall thickenings on the outer side of the pipe to the inner side of the pipe by subsequent rolling so as to produce a pipe having a constant outer diameter over the entire length.

11. The method as claimed in claim 10, wherein the wall thickenings are urged completely to the inner side of the pipe by a mandrel bar extracting mill, which is located downstream of the mandrel bar rolling mill, or a stretch-reducing mill.

12. The method as claimed in claim 11, further comprising subsequently urging in part the wall thickenings from the inner side of the pipe to the outer side of the pipe by a calibrating press.

13. The method as claimed in claim 12, wherein the produced wall thickenings extend in the longitudinal direction of the pipe over a length of at least 300 mm.

14. The method as claimed in claim 1, wherein the produced wall thickenings extend in the longitudinal direction of the pipe over a length of at least 300 mm.

15. The method as claimed in claim 14, further comprising extracting the mandrel bar from the pipe after rolling in the mandrel bar rolling mill and subsequently urging the wall thickenings on the outer side of the pipe to the inner side of the pipe by subsequent rolling so as to produce a pipe having a constant outer diameter over the entire length.

16. The method as claimed in claim 15, wherein the wall thickenings are urged completely to the inner side of the pipe by a mandrel bar extracting mill, which is located downstream of the mandrel bar rolling mill, or a stretch-reducing mill.

17. The method as claimed in claim 16, further comprising subsequently urging in part the wall thickenings from the inner side of the pipe to the outer side of the pipe by a calibrating press.

* * * * *